US008919564B2

(12) United States Patent
Noguchi

(10) Patent No.: US 8,919,564 B2
(45) Date of Patent: Dec. 30, 2014

(54) PACKAGING CASE AND PACK BODY

(71) Applicant: KYOCERA Document Solutions Inc., Osaka-shi, Osaka (JP)

(72) Inventor: Yohei Noguchi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/261,302

(22) Filed: Apr. 24, 2014

(65) Prior Publication Data

US 2014/0319011 A1 Oct. 30, 2014

(30) Foreign Application Priority Data

Apr. 27, 2013 (JP) ..... 2013-094822

(51) Int. Cl.
*B65D 81/02* (2006.01)
*B65D 5/42* (2006.01)

(52) U.S. Cl.
CPC ..... *B65D 5/42* (2013.01)
USPC ..... 206/722; 206/594

(58) Field of Classification Search
USPC ..... 206/521, 591, 592, 594, 588, 590, 499, 206/701, 722, 723, 724
See application file for complete search history.

(56) References Cited

U.S. PATENT DOCUMENTS

| | | | | |
|---|---|---|---|---|
| 6,340,087 | B1 * | 1/2002 | Bridges et al. | 206/523 |
| 2006/0131207 | A1 * | 6/2006 | Kari | 206/591 |
| 2012/0168330 | A1 * | 7/2012 | Zeng et al. | 206/320 |

FOREIGN PATENT DOCUMENTS

| | | | |
|---|---|---|---|
| JP | 2005001682 | A | 1/2005 |
| JP | 2009057063 | A | 3/2009 |

* cited by examiner

*Primary Examiner* — Jacob K Ackun
(74) *Attorney, Agent, or Firm* — Alleman Hall McCoy Russell & Tuttle LLP

(57) ABSTRACT

A packaging case includes a body, a fixed support portion, and a movable support portion. Body includes storage space, and has openings that are formed in top face thereof and bottom face thereof and that are in communication with storage space. Fixed support portion is fixed to body and is provided at first position at which fixed support portion is capable of supporting article to be packed stored in storage space. Movable support portion is provided in body so as to be movable in storage space, is configured to support article at first position, along with fixed support portion, and is configured to move, when packaging case has been taken out of exterior case and placed on predetermined face, to second position defined above first position to support article in a state where at least a part of article is exposed from opening in top face to outside.

8 Claims, 7 Drawing Sheets

PACKAGING CASE AND PACK BODY

INCORPORATION BY REFERENCE

This application is based upon and claims the benefit of priority from the corresponding Japanese Patent Application No. 2013-094822 filed on Apr. 27, 2013, the entire contents of which are incorporated herein by reference.

BACKGROUND

The present disclosure relates to a packaging case to be stored in an exterior case and a pack body including the packaging case.

Products such as image forming apparatuses and information processing apparatuses are distributed on the market, in a state where each product is stored in an exterior case such as a corrugated board case. In the exterior case, attachments of the product are also packed together with the product. In the course of the distribution, if the product and the attachments are brought into contact with each other due to vibration during the transport, flaws due to the contact or damages are caused. Moreover, there are cases where the product and the attachments are damaged under an unexpected shock during the transport. Therefore, conventionally, the product is stored in the exterior case in a state where the product is protected with a cushioning material such as expanded polystyrene. Further, such attachments are packed in a packaging box together with the product, in a state where the attachments are stored in an inner container (packaging case) formed from a corrugated board or the like and having cushioning characteristics. As one example of an inner container of this kind, a packing container provided with a handle is known. Further, there is known a packaging member that can store and hold the attachments such as manuals after an article to be packed has been packed in an exterior case.

Attachments to be packed together with a product such as an image forming apparatus or an information processing apparatus include not only articles that are less likely to be damaged even under a shock, such as manuals and cables, but also articles that are easily damaged under a shock, such as a toner cartridge, a liquid crystal monitor, and a keyboard. In order to make such attachments less likely to be affected by shocks or vibrations, the attachments are stored in an inner container, in a state where the attachments are fitted in a storage space formed in the inner container and the peripheries of the attachments are held therein. Therefore, the conventional inner container or packing container does not allow the attachments stored in the container to be easily taken out thereof. In addition, the handle of the conventional packing container is to allow the packing container to be easily taken out of the exterior case, and is not to allow the attachments to be easily taken out of the inner container. Moreover, the conventional packaging member described above is to allow attachments such as manuals to be easily stored even after packing has been completed, and is not to allow the attachments to be easily taken out of the packaging member.

SUMMARY

A packaging case according to one aspect of the present disclosure is stored in an exterior case. The packaging case includes a body, a fixed support portion, and a movable support portion. The body includes a storage space in which an article to be packed is to be stored, and has openings that are formed in a top face thereof and a bottom face thereof and that are in communication with the storage space. The fixed support portion is fixed to the body and is provided at a first position at which the fixed support portion is capable of supporting the article stored in the storage space. The movable support portion is provided in the body so as to be movable in the storage space, is configured to support the article at the first position, along with the fixed support portion, and is configured to move, when the packaging case has been taken out of the exterior case and placed on a predetermined face, to a second position defined above the first position to support the article, in a state where at least a part of the article is exposed from the opening in the top face to outside.

A pack body according to another aspect of the present disclosure includes the packaging case, the product having a recessed portion formed in a top face thereof, and the exterior case having the packaging case and the product being packed therein. In the pack body, the packaging case is arranged above the product, in a state where the movable support portion protrudes into the recessed portion when an entirety of the article is stored in the storage space and the movable support portion is at the first position.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an embodiment of the present disclosure will be described with reference to the drawings as appropriate. It should be noted that the embodiment described below is merely an example embodying the present disclosure, and the embodiment of the present disclosure can be modified as appropriate within a range not changing the gist of the present disclosure.

[Schematic Description of Packing Member 10]

Figure 1A:
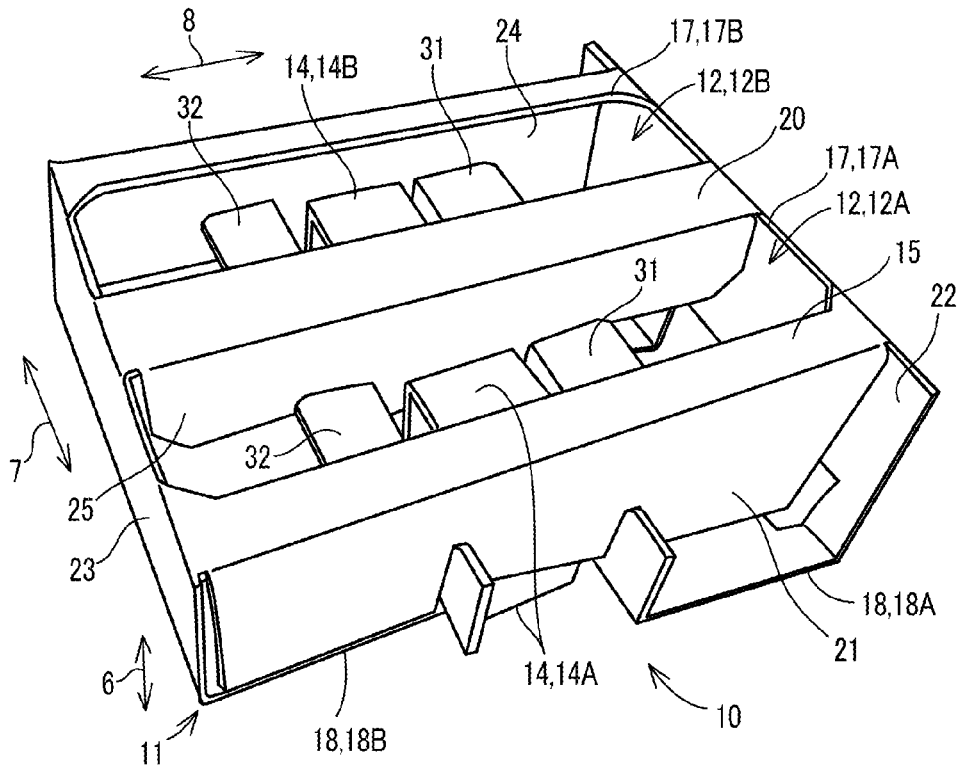
FIG. 1A and FIG. 1B are each a perspective view showing a structure of a packing member according to an embodiment of the present disclosure.
Figure 1B:
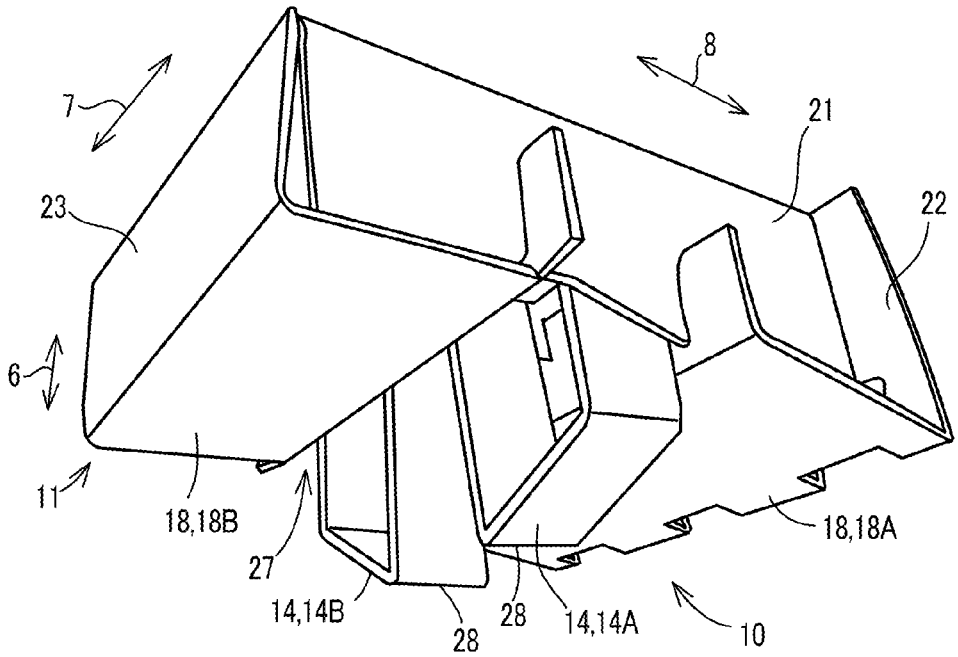

First, with reference to FIG. 1A and FIG. 1B, a schematic structure of a packing member 10 (one example of a packaging case of the present disclosure) according to an embodiment of the present disclosure will be described. The packing member 10 is to store an article to be packed therein. The packing member 10 with the article stored therein is to be packed in a packaging box 97 (see FIG. 4A, one example of an exterior case of the present disclosure), together with another article to be packed. The packing member 10 is also referred to as a packing container or an inner container. As shown in FIG. 1A and FIG. 1B, the packing member 10 includes: a body 11 (one example of a body of the present disclosure) in which two storage spaces 12A and 12B (one example of a storage space of the present disclosure) are formed; and two movable portions 14A and 14B (one example of a movable support portion of the present disclosure). In the following, the storage spaces 12A and 12B are also collectively referred to as storage spaces 12, and the movable portions 14A and 14B are also collectively referred to as movable portions 14. FIG. 1A is a perspective view of the packing member 10, viewed from diagonally above. FIG. 1B is a perspective view of the packing member 10, viewed from diagonally below.

In each of the two storage spaces 12, an article to be packed is to be stored. In a state where the articles are stored in the storage spaces 12, the packing member 10 is stored in the packaging box 97 such as a corrugated board box. One example of the articles to be stored in the storage space 12 is a toner cartridge to be used in an image forming apparatus 100 described later. In the present embodiment, the packing member 10 capable of storing, as the article, a toner cartridge having a long rectangular parallelepiped shape is exemplified. However, the present disclosure can be applied to a packing member capable of storing articles of various shapes to be used in various usages.

As shown in FIG. 1A, the body 11 is formed in a substantially box shape, which is a substantially rectangular parallelepiped shape whose dimension in a height direction 6 is small, and whose dimensions in a longitudinal direction 7 and a lateral direction 8 are substantially equal to each other and are greater than the dimension in the height direction 6. In the body 11, two openings 17 (17A, 17B) are formed in a top face 15 thereof. The openings 17 each have a substantially rectangular shape long in the lateral direction 8, and are in communication with the storage spaces 12, respectively. The storage spaces 12 each having a predetermined depth are formed from the openings 17 toward bottom walls 18 (18A, 18B) forming the bottom face of the body 11. The two storage spaces 12 are formed long in the lateral direction 8, and are arranged side by side in the longitudinal direction 7 so as to sandwich a partition portion 20 provided in the middle of the body 11. Each storage space 12 is designed to have a shape corresponding to the form of an article to be packed to be stored therein. Moreover, as shown in FIG. 1B, the body 11 is provided with an opening 27 formed in a middle portion of the bottom face thereof. The opening 27 is in communication with the storage spaces 12.

The storage spaces 12 are defined by side walls 21 to 24 forming the outer periphery of the body 11, partitioning walls 25 and 26 forming side faces in the longitudinal direction 7 of the partition portion 20, and support pieces 31 and 32 (one example of a fixed support portion of the present disclosure) serving as a support face 30 (see FIG. 4A and FIG. 4B) on the bottom side. Specifically, the inner periphery of the storage space 12A located near side in FIG. 1A is formed by a first side wall 21 on the near side in FIG. 1A, a second side wall 22 on the right, a third side wall 23 on the left, and the partitioning wall 25. The support face 30 (see FIG. 4A and FIG. 4B) on the bottom side of the storage space 12A is formed by the respective top faces of the support piece 31, the support piece 32, and the movable portion 14A. That is, the respective top faces of the support piece 31, the support piece 32, and the movable portion 14A support an article to be packed in the storage space 12A. The inner periphery of the storage space 12B located on the far side in FIG. 1A is formed by a fourth side wall 24 on the far side in FIG. 1A, the second side wall 22 on the right, the third side wall 23 on the left, and the partitioning wall 26. The support face 30 on the bottom side of the storage space 12B is formed by the respective top faces of the support piece 31, the support piece 32, and the movable portion 14B. That is, the respective top faces of the support piece 31, the support piece 32, and the movable portion 14B support an article to be packed in the storage space 12B. By being stored in the storage spaces 12 formed in this manner, the articles are stored without becoming loose. It should be noted that the support pieces 31 and 32 are one example of a support potion of the present disclosure, and is integrally fixed to the body 11 by a cut member 35 (see FIG. 2) being assembled in the manner as described later. The support pieces 31 and 32 form the bottom walls 18 (18A, 18B) of the body 11.

The movable portions 14 are movably provided in the body 11, and support, along with the support pieces 31 and 32, the bottom faces of the articles in the storage spaces 12. The movable portions 14 are provided so as to correspond to the two storage spaces 12, respectively. That is, the movable portions 14 are provided in the body 11 so as to be movable in the two storage spaces 12, respectively. Each movable portion 14 is extended in the depth direction from the storage space 12 toward the bottom face (the face formed by the bottom walls 18) of the body 11. The movable portion 14 is supported by the body 11 so as to be movable between a first position and a second position described later. The first position is a position (the position shown in FIG. 4A and FIG. 5A) at which the movable portion 14 protrudes, in the downward direction, from a support face 93 of the body 11 at the time when the packing member 10 has been taken out of the packaging box 97 (see FIG. 4A) and is supported by the top face (corresponding to a predetermined placement face of the present disclosure) of a placement base 94 (see FIG. 4B) described later. The second position is a position (the position shown in FIG. 4B and FIG. 5B) distanced from the first position in the upward direction, which is opposite to the downward direction. More specifically, the first position is a position at which the article is supported, where in a state where the packing member 10 is stored at a predetermined position within the packaging box 97 (case storage state), the movable portion 14 protrudes from the opening 27 formed in the bottom face of the body 11 to the outside of the bottom face of the body 11, and at the same time, the entirety of the article is stored in the storage space 12. The second position is a position at which the article is supported, where in a state were the packing member 10 has been taken out of the packaging box 97 and placed on the top face of the placement base 94 or the like (case placement state), the movable portion 14 is sunk within the storage space 12 from the opening 27 in the bottom face of the body 11, and at the same time, at least a part of the article stored in the storage space 12 is exposed to the outside from the opening 17 in the top face 15. In the present embodiment, when the movable portion 14 is at the first position, the storage space 12 is enlarged, whereby the entirety of the article can be stored in the storage space 12. Further, when the movable portion 14 moves upward from the first position to the second position, the movable portion 14 is included within the storage space 12. Accordingly, the article stored within the storage space 12 is pushed up, to be exposed above the opening 17.

[Detail of the Packing Member 10]

Figure 2:
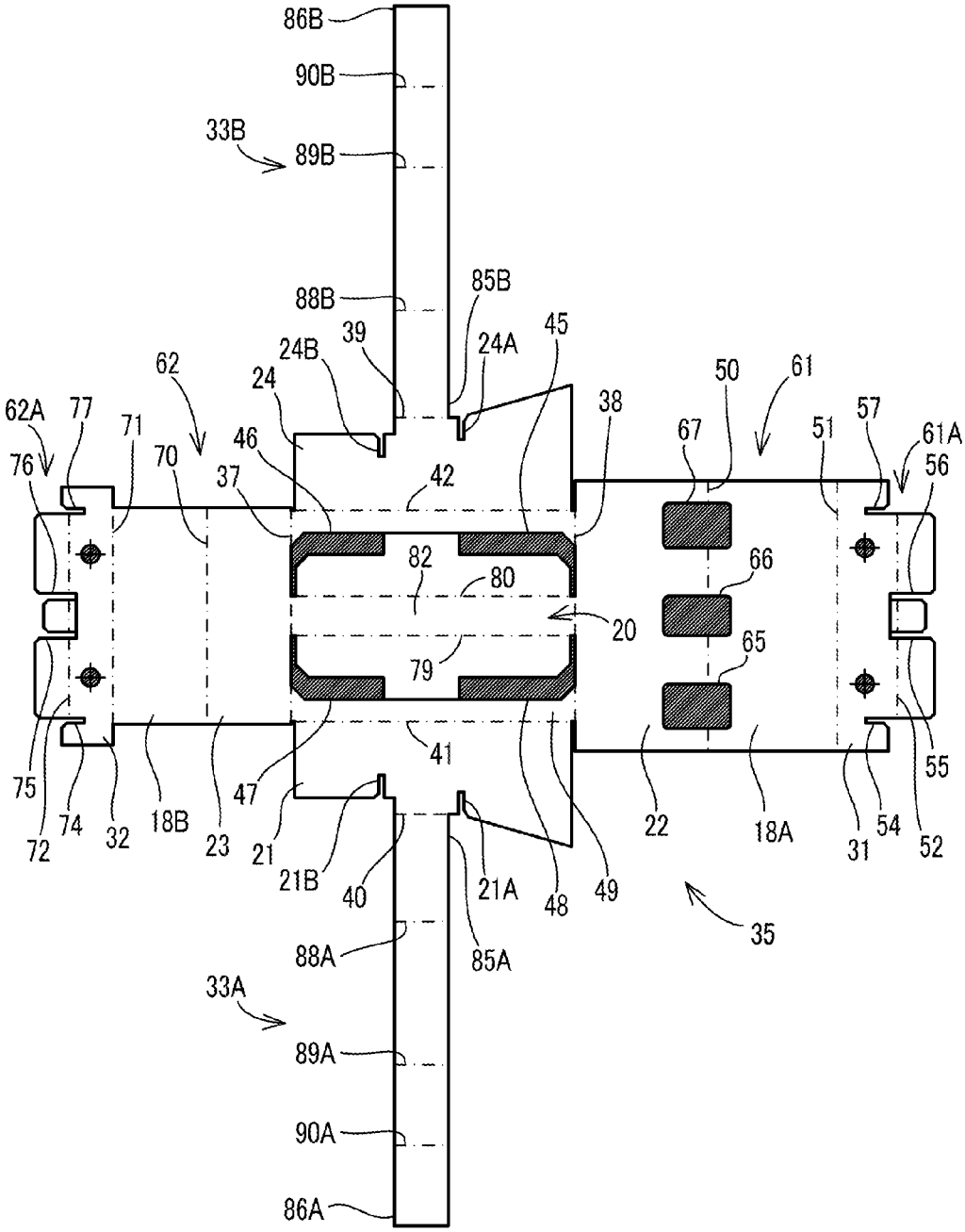
FIG. 2 is a developed view showing a developed state of the packing member according to the embodiment of the present disclosure.
Figure 3:
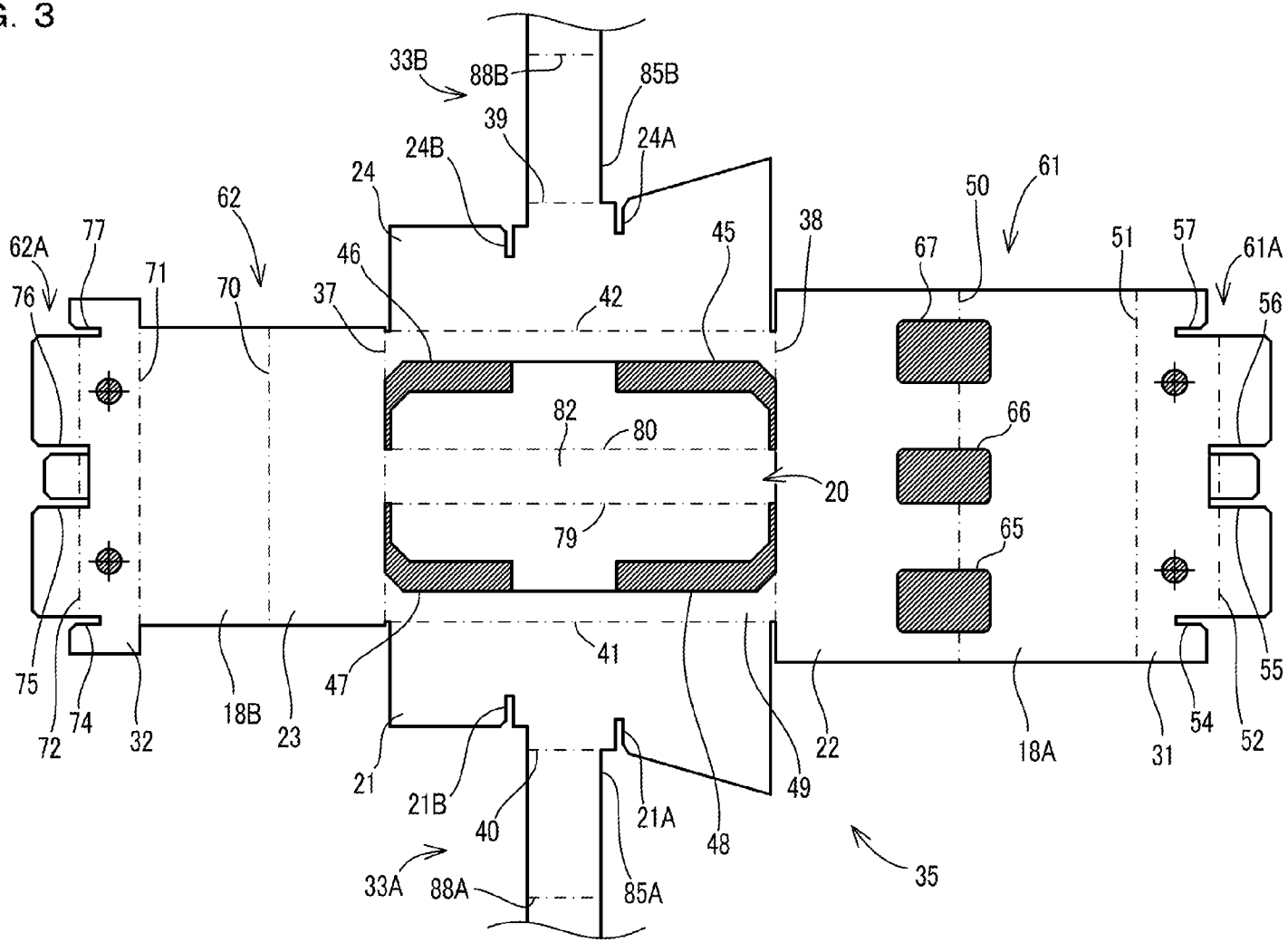
FIG. 3 is a developed view showing a developed state of the packing member according to the embodiment of the present disclosure.

In the following, with reference to FIG. 2 and FIG. 3, a detailed structure of the packing member 10 will be described. In FIG. 2 and FIG. 3, hatched portions represent through holes. The packing member 10 is formed from a sheet-like cushioning material such as a sheet material made of a corrugated board. Specifically, the body 11, the support pieces 31 and 32, and the movable portions 14 are integrally formed by the cut member 35 that is obtained by a corrugated board sheet being cut as shown in the developed views in FIG. 2 and FIG. 3. The packing member 10 is structured by the cut member 35 being bent or the like to be assembled. The cut member 35 is formed from a corrugated board sheet whose entire thickness is constant. Therefore, the strength of each portion of the cut member 35 is constant. The thickness of the cut member 35 is not limited to any particular value, but in the present embodiment, the cut member 35 having a thickness of substantially 5 mm is employed. In the present embodiment, the cut member 35 in which the body 11 and the movable portions 14 are integrally formed is shown as an example. However, in order to reduce wasteful use of the corrugated board sheet, a cut member corresponding to the body 11 and cut members corresponding to the movable portions 14 are separately prepared by cutting a corrugated board sheet, and the cut members may be coupled to each other by use of a joining component such as an adhesive.

As shown in FIG. 2 and FIG. 3, in the cut member 35, folds 37 to 42 defining portions, and through holes 45 to 48 are formed. Accordingly, the cut member 35 is defined into a top face portion 49 forming the top face 15, the partition portion 20, a strip portion 33A, a strip portion 33B, the first side wall 21, a first side peripheral portion 61 including the second side wall 22, a second side peripheral portion 62 including the third side wall 23, and the fourth side wall 24. Among these components, the top face portion 49, the partition portion 20, the first side wall 21, the first side peripheral portion 61, the second side peripheral portion 62, and the fourth side wall 24 form the body 11 of the packing member 10. Further, the strip portions 33A and 33B form the movable portions 14A and 14B, respectively.

As shown in FIG. 3, the top face portion 49 is formed in a substantially rectangular shape. The top face portion 49 is continued to the first side wall 21, the first side peripheral portion 61, the second side peripheral portion 62, and the fourth side wall 24. Here, "being continued" does not mean being joined by means of an adhesive or the like, but means being integrally formed with adjacent components. The first side wall 21 is continued to one long side of the top face portion 49, and between the top face portion 49 and the first side wall 21, a fold 41 is formed. In the fold 41, slits (not shown) are formed at equal intervals so as to facilitate folding. The fourth side wall 24 is continued to the other long side of the top face portion 49, and between the top face portion 49 and the fourth side wall 24, a fold 42 is formed. Also, in the fold 42, the slits are formed. The first side peripheral portion 61 is continued to one short side of the top face portion 49, and between the top face portion 49 and the first side peripheral portion 61, a fold 38 is formed. Moreover, the second side peripheral portion 62 is continued to the other short side of the top face portion 49, and between the top face portion 49 and the second side peripheral portion 62, the fold 37 is formed. In FIG. 3, relative to the top face portion 49, the first side wall 21 is folded along the fold 41 toward the far side at a substantially right angle. Similarly, the fourth side wall 24 is folded along the fold 42 toward the far side, the first side peripheral portion 61 is folded along the fold 38 toward the far side, and the second side peripheral portion 62 is folded along the fold 37 toward the far side, each at a substantially right angle.

The first side peripheral portion 61 is formed in a substantially rectangular shape. In the first side peripheral portion 61, three folds 50 to 52 in parallel to the fold 38 are formed. The first side peripheral portion 61 is further folded along the folds 50 to 52, each at substantially right angle. By the first side peripheral portion 61 being folded along the fold 50 on the fold 38 side, the portion between the fold 38 and the fold 50 becomes the second side wall 22. Moreover, by the first side peripheral portion 61 being folded along the fold 51 adjacent to the fold 50, the bottom wall 18A, on the second side wall 22 side, which will serve as a part of the bottom face of the body 11 is formed. That is, the portion between the fold 50 and the fold 51 becomes the bottom wall 18A. In the first side peripheral portion 61, four engagement grooves 54 to 57 are formed at an end 61A opposite to the top face portion 49. The engagement grooves 54 and 57 located on opposite sides of the end 61A engage with the first side wall 21 and the fourth side wall 24, respectively. Specifically, the engagement groove 54 is inserted in an engagement groove 21A formed in the first side wall 21, to be engaged therewith, and the engagement groove 57 is inserted in an engagement groove 24A formed in the fourth side wall 24, to be engaged therewith. Engagement grooves 55 and 56 are engaged with the partitioning walls 25 and 26 of the partition portion 20 after the fold 52 adjacent to the end 61A is folded at a substantially right angle. Accordingly, the portion between the fold 52 and the end 61A comes to serve as the support piece 31.

The first side peripheral portion 61 is provided with three short through holes 65 to 67 formed so as to cross the fold 50. These through holes 65 to 67 are provided in order to reduce the strength in the folded portion when the fold 50 is folded, to enhance the cushioning characteristics in the height direction 6 of the second side wall 22.

The second side peripheral portion 62 is formed in a substantially rectangular shape. In the second side peripheral portion 62, three folds 70 to 72 in parallel to the fold 37 are formed. The second side peripheral portion 62 is further folded along the folds 70 to 72, each at a substantially right angle. By the second side peripheral portion 62 being folded along the fold 70 on the fold 37 side, the portion between the fold 37 and the fold 70 becomes the third side wall 23. Moreover, by the second side peripheral portion 62 being folded along the fold 71 adjacent to the fold 70, the bottom wall 18B, on the third side wall 23 side, which will serve as a part of the bottom face of the body 11 is formed. That is, the potion between the fold 70 and the fold 71 becomes the bottom wall 18B. In the second side peripheral portion 62, four engagement grooves 74 to 77 are formed at an end 62A opposite to the top face portion 49. The engagement grooves 74 and 77 located on opposite sides of the end 62A engage with the first side wall 21 and the fourth side wall 24, respectively. Specifically, the engagement groove 74 is inserted in an engagement groove 21B formed in the first side wall 21, to be engaged therewith, and the engagement groove 77 is inserted in an engagement groove 24B formed in the fourth side wall 24, to be engaged therewith. Engagement grooves 75 and 76 are engaged with the partitioning walls 25 and 26 of the partition portion 20 after the fold 72 adjacent to the end 62A is folded at a substantially right angle. Accordingly, the portion between the fold 72 and the end 62A comes to serve as the support piece 32.

The top face portion 49 is provided with the through holes 45 to 48. The through holes 45 to 48 are formed near the four corners of the top face portion 49, respectively. The portion surrounded by the through holes 45 to 48 is the partition portion 20. In the partition portion 20, folds 79 and 80 are formed that define the partition portion 20 into three in the short side direction of the top face portion 49. In each of the folds 79 and 80, the slits are formed. The partition portion 20 is continued to the first side peripheral portion 61 at the fold 38, and continued to the second side peripheral portion 62 at the fold 37, and the other portion of the partition portion 20 is cut to be separated from the top face portion 49. The partition portion 20 is folded toward the far side at the folds 79 and 80, relative to a middle portion 82 sandwiched by the fold 79 and the fold 80. Accordingly, the partitioning walls 25 and 26 of the partition portion 20 are formed. The partitioning walls 25 and 26 formed in this manner are respectively engaged with the engagement grooves 55 and 56 and the engagement grooves 75 and 76. When folding at the fold 79 is performed, the through hole 47 and the through hole 48 are continued to each other to form an enlarged hole, thereby forming the opening 17A (see FIG. 1A) of the storage space 12A. When folding at the fold 80 is performed, the through hole 45 and through hole 46 are continued to each other to form an enlarged hole, thereby forming the opening 17B (see FIG. 1A) of the storage space 12B.

As shown in FIG. 2, the strip portion 33A is formed in a long strip shape. The strip portion 33A is continued to the first side wall 21. That is, a proximal end portion 85A on the first side wall 21 side of the strip portion 33A is connected to the first side wall 21 forming the body 11. The proximal end portion 85A corresponds to a fixed end of the present disclosure. In the present embodiment, the strip portion 33A is formed in a long shape extended from the proximal end portion 85A, and a distal end portion 86A thereof is not connected to any portion and is displaceable. The distal end portion 86A corresponds to a free end of the present disclosure. In the strip portion 33A, in addition to a fold 40 formed at the connection portion to the first side wall 21, three folds 88A to 90A parallel to the fold 40 are formed at predetermined intervals. The strip portion 33A is folded toward the far side in the sheet in the same direction along the folds 40, 88A to 90A, whereby the movable portion 14A having a quadrangular shape surrounded by four faces is structured (see FIG. 5A and FIG. 5B). Since the movable portion 14A has this structure, although the proximal end portion 85A is fixed to the body 11, the distal end portion 86A is movable in the longitudinal direction in the storage space 12A.

Similar to the strip portion 33A, the strip portion 33B is formed in a long strip shape. The strip portion 33B is continued to the fourth side wall 24. That is, a proximal end portion 85B on the fourth side wall 24 side of the strip portion 33B is connected to the fourth side wall 24 forming the body 11. The proximal end portion 85B corresponds to a fixed end of the present disclosure. In the present embodiment, the strip portion 33B is formed in a long shape extended from the proximal end portion 85B, and a distal end portion 86B thereof is not connected to any portion and is displaceable. The distal end portion 86B corresponds to a free end of the present disclosure. In the strip portion 33B, in addition to a fold 39 formed at the connection portion to the fourth side wall 24, three folds 88B to 90B parallel to the fold 39 are formed at predetermined intervals. The strip portion 33B is folded toward the far side in the sheet in the same direction along the folds 39, 88B to 90B, whereby the movable portion 14B having a quadrangular shape surrounded by four faces is structured (see FIG. 5A and FIG. 5B). Since the movable portion 14B has this structure, although the proximal end portion 85B is fixed to the body 11, the distal end portion 86B is movable in the longitudinal direction in the storage space 12B.

[Method for Assembling Packing Member 10]

Next, a method for assembling the packing member 10 structured as above will be described. First, an assembler folds the partition portion 20 along the folds 79 and 80 into mountain folds, and folds the top face portion 49 along the folds 41 and 42 into mountain folds. Further, the assembler folds the first side peripheral portion 61 along the folds 50 to 52 into mountain folds. Then, the engagement groove 54 at the end 61A is inserted into the engagement groove 21A of the first side wall 21, and the engagement groove 57 is inserted into the engagement groove 24A of the fourth side wall 24. Accordingly, each of the first side wall 21 and the fourth side wall 24 is coupled to the first side peripheral portion 61. Further, the partitioning walls 25 and 26 of the partition portion 20 are inserted into the engagement grooves 55 and 56 at the end 61A, respectively. Accordingly, each of the partitioning walls 25 and 26 is coupled to the first side peripheral portion 61. Similarly, the second side peripheral portion 62 is folded along the folds 70 to 72 into mountain folds. Then, the engagement groove 74 at the end 62A is inserted into the engagement groove 21B of the first side wall 21, and the engagement groove 77 is inserted into the engagement groove 24B of the fourth side wall 24. Accordingly, each of the first side wall 21 and the fourth side wall 24 is coupled to the second side peripheral portion 62. Further, the partitioning walls 25 and 26 of the partition portion 20 are inserted into the engagement grooves 75 and 76 at the end 62A, respectively. Accordingly, each of the partitioning walls 25 and 26 is coupled to the second side peripheral portion 62. As a result, the body 11 is assembled.

Moreover, the assembler folds the strip portion 33A along the folds 40 and 88A to 90A into mountain folds. At this time, the assembler makes it sure that a quadrangular shape is formed by the strip portion 33A. Then, the strip portion 33A that has been folded is inserted, from below, into the storage space 12A formed in the body 11. Accordingly, the movable portion 14A is completed. Similarly, the assembler folds the strip portion 33B along the folds 39 and 88B to 90B into mountain folds. At this time, the assembler makes it sure that a quadrangular shape is formed by the strip portion 33B. Then, the strip portion 33B that has been folded is inserted, from below, into the storage space 12B formed in the body 11. Accordingly, the movable portion 14B is assembled. Through the above assembling steps, the packing member 10 according to the present embodiment shown in FIG. 1A and FIG. 1B is completed.

[Movement of Packing Member 10]

Figure 4A:
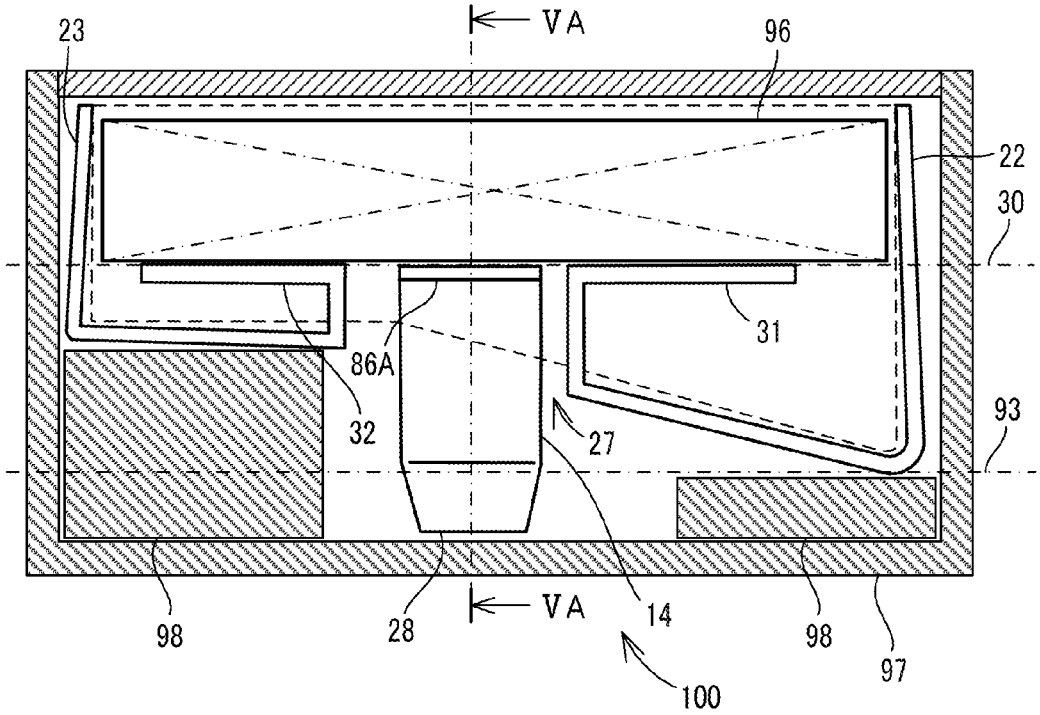
FIG. 4A and FIG. 4B are each a schematic diagram for explaining movement of the packing member and an article to be packed according to the embodiment of the present disclosure.
Figure 4B:
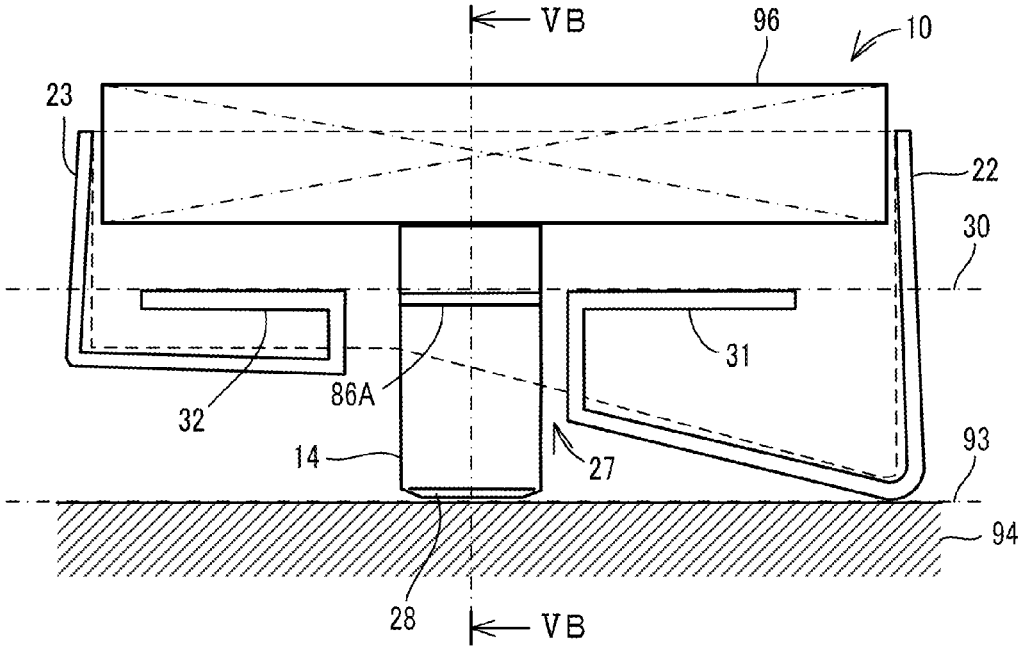
Figure 5A:
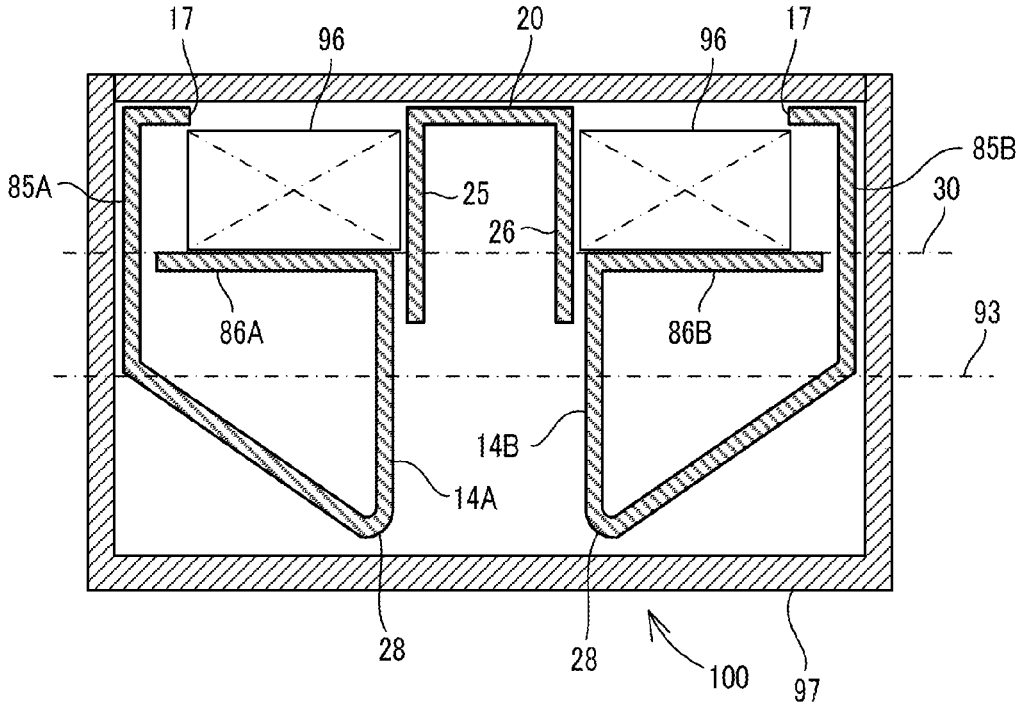
FIG. 5A and FIG. 5B are each a schematic diagram for explaining movement of the packing member and the article according to the embodiment of the present disclosure.
Figure 5B:
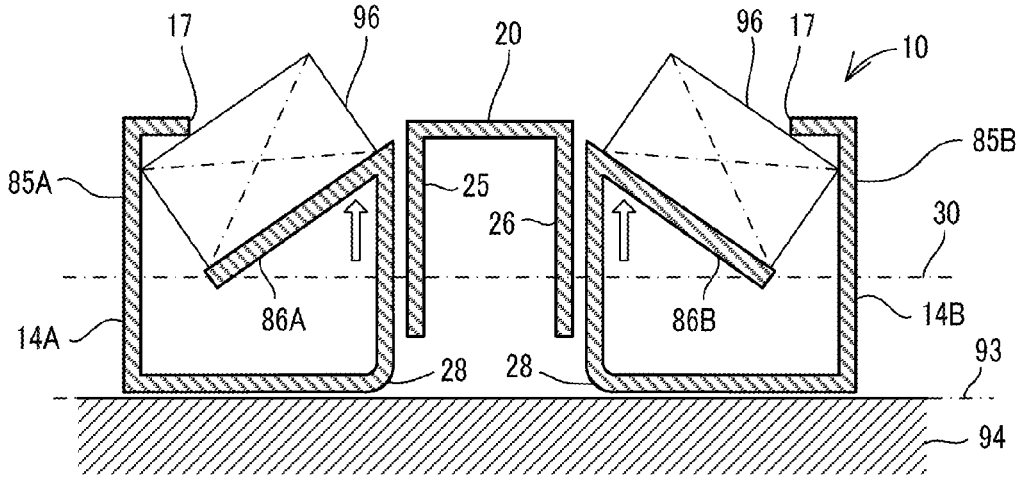

In the following, with reference to FIG. 4A to FIG. 5B, movement of the packing member 10 in which a toner cartridge 96 having a long shape being one example of an article to be packed is stored in each storage space 12 will be described. FIG. 4A to FIG. 5B are schematic diagrams for explaining movement of the packing member 10 and the toner cartridge 96. FIG. 4A and FIG. 4B each are a cross-sectional view schematically showing a cross sectional structure of the storage space 12A, cut at the center thereof along the lateral direction 8 in FIG. 1A. FIG. 4A shows a state (case storage state) in which the packing member 10 is packed in the packaging box 97 such as a corrugated board box. FIG. 5A is a schematic diagram showing a cross sectional structure viewed from a cutting line VA-VA in FIG. 4A. FIG. 4B shows a state (case placement state) in which the packing member 10 is placed on the placement base 94 which is flat, after the packing member 10 has been taken out of the packaging box 97. FIG. 5B is a schematic diagram showing a cross sectional structure viewed from a cutting line VB-VB in FIG. 4B. For convenience of description, in FIG. 4, a part of the body 11 is shown in broken lines.

With respect to the packing member 10 of the present embodiment, when the toner cartridges 96 are stored in the storage spaces 12, as shown in FIG. 4A and FIG. 4B, the bottom face of each toner cartridge 96 is supported by the top faces of the support pieces 31 and 32. At this time, the distal end portions 86A and 86B of the movable portions 14 are pushed downwardly by the toner cartridges 96. Accordingly, the distal end portions 86A and 86B of the movable portions 14 are pushed downwardly to the support face 30 at which the toner cartridges 96 are supported. That is, the movable portions 14 are moved downwardly. In this state, the movable portions 14 support the toner cartridges 96, along with the support pieces 31 and 32. At this time, as shown in FIG. 4A and FIG. 5A, the movable portions 14 project downwardly from the opening 27 to take the first position at which lower end portions 28 of the movable portions 14 protrude in the downward direction from the support face 93. That is, the first position is a position at which the top faces of the support pieces 31 and 32 and the distal end portions 86A and 86B of the movable portions 14 support the bottom faces of the toner cartridges 96. It should be noted that the support face 93 is a support face at the time when the packing member 10 is placed on the placement base 94 and supported by the top face of the placement base 94, and includes the support points at which the packing member 10 is supported by the placement base 94. In the present embodiment, the packing member 10 is supported inside the packaging box 97 by the bottom walls 18A and 18B coupled to the body 11.

In a case where the packing member 10 alone is stored and packed in the packaging box 97, as shown in FIG. 4A and FIG. 5A, the packing member 10 is stored in the packaging box 97 such that the lower end portions 28 of the movable portions 14 do not come into contact with the bottom face of the packaging box 97. For example, the packing member 10 is stored such that cushioning materials 98 or the like are interposed between the packing member 10 and the bottom face of the packaging box 97 to form, below the packing member 10, a space which allows the lower end portions 28 to protrude thereinto, and at the same time, the bottom walls 18 of the packing member 10 are lifted by the cushioning materials 98. The procedure of taking the toner cartridges 96 out of a pack body 100 in which the packing member 10 is packed in the packaging box 97 is as follows. First, the pack body 100 is opened and the packing member 10 is taken out of the packaging box 97, and then, the packing member 10 is placed on the placement base 94 having a flat face. Through this simple work, the movable portions 14 protruding from the support face 93 will move from the first position to the second position. Specifically, the lower end portions 28 of the movable portions 14 are pushed upwardly by the placement base 94. Accordingly, the movable portions 14 will move to the second position where the lower end portions 28 are distanced above from the support face 93. That is, the movable portions 14 move upwardly toward the second position. When the movable portions 14 have moved upwardly, the distal end portions 86A and 86B of the movable portions 14 are pushed up above the support face 30, and the distal end portions 86A and 86B move inside the storage spaces 12. That is, at the second position, the distal end portions 86A and 86B of the movable portions 14 are positioned within the storage spaces 12. At this time, associated with the upward movement of the lower end portions 28 of the movable portions 14, the distal end portions 86A and 86B having been flat are inclined as shown in FIG. 5B. Moreover, associated with the movement of the movable portions 14, as shown in FIG. 4B and FIG. 5B, the toner cartridges 96 are pushed upwardly from the storage spaces 12, to be exposed from the openings 17 to the outside. That is, the second position is a position, defined above the first position, that is taken when the packing member 10 has been taken out of the packaging box 97 and placed on the placement base 94. At the second position, the packing member 10 is supported in a state where at least a part of each toner cartridge 96 is exposed from the opening 17 to the outside. In the present embodiment, as shown FIG. 5B, a pushing up force is applied to each toner cartridge 96, at a portion thereof on the partition portion 20 side. Therefore, the toner cartridges 96 are pushed in the directions of the white arrows shown in FIG. 5B, and portions, on the partition portion 20 side, of the toner cartridges 96 are exposed from the top face 15 of the body 11 to the outside.

[Effects of the Embodiment]

Since the packing member 10 is structured as described above, when the packing member 10 is to be packed in the packaging box 97 along with other articles, the articles such as the toner cartridges 96 are supported by the support pieces 31 and 32 in a state where the movable portions 14 protrude downwardly from the bottom face of the body 11. Accordingly, the entirety of the toner cartridges 96 can be stored in the storage spaces 12. Moreover, by taking, out of the packaging box 97, the packing member 10 in which the articles such as toner cartridges 96 are stored, and by placing the packing member 10 on the placement base 94 which is flat, the support position by the movable portions 14 shifts from the first position to the second position. Associated with this movement, the articles are exposed from the packing member 10, to above the top face 15. That is, the articles move to a position at which they are easily taken out by a user. Accordingly, the user becomes able to take out each article by grabbing it, and thus taking-out work becomes easy. Moreover, simply by placing the packing member 10 on the placement base 94 or the like, the article is exposed from the packing member 10. Therefore, even in a case where the presence/absence or the position of an article to be packed in the packing member 10 is unknown, it is possible to allow the user to catch the sight of the article that has been exposed. Accordingly, it is possible to allow the user to recognize the presence/absence and the position of the article in the packing member 10.

Moreover, since the packing member 10 is formed from a material having cushioning characteristics such as a corrugated board sheet, the packing member 10 acts as a cushioning material for the article stored in the packing member 10. Further, in a case where another article is packed in the packaging box 97 together with the packing member 10, the packing member 10 also acts as a cushioning material for this other article that is packed together therewith.

In the above embodiment, an example has been described in which the cut member 35 is made of a corrugated board sheet being a sheet-like cushioning material, and this cut member 35 is folded to form the packing member 10. However, for example, the body 11 may be formed from a cushioning material such as expanded polystyrene, and to this body 11, each movable portion 14 may be movably supported. At this time, the movable portion 14 may be formed from a sheet-like cushioning material, or may be formed from a cushioning material such as expanded polystyrene.

Figure 6:
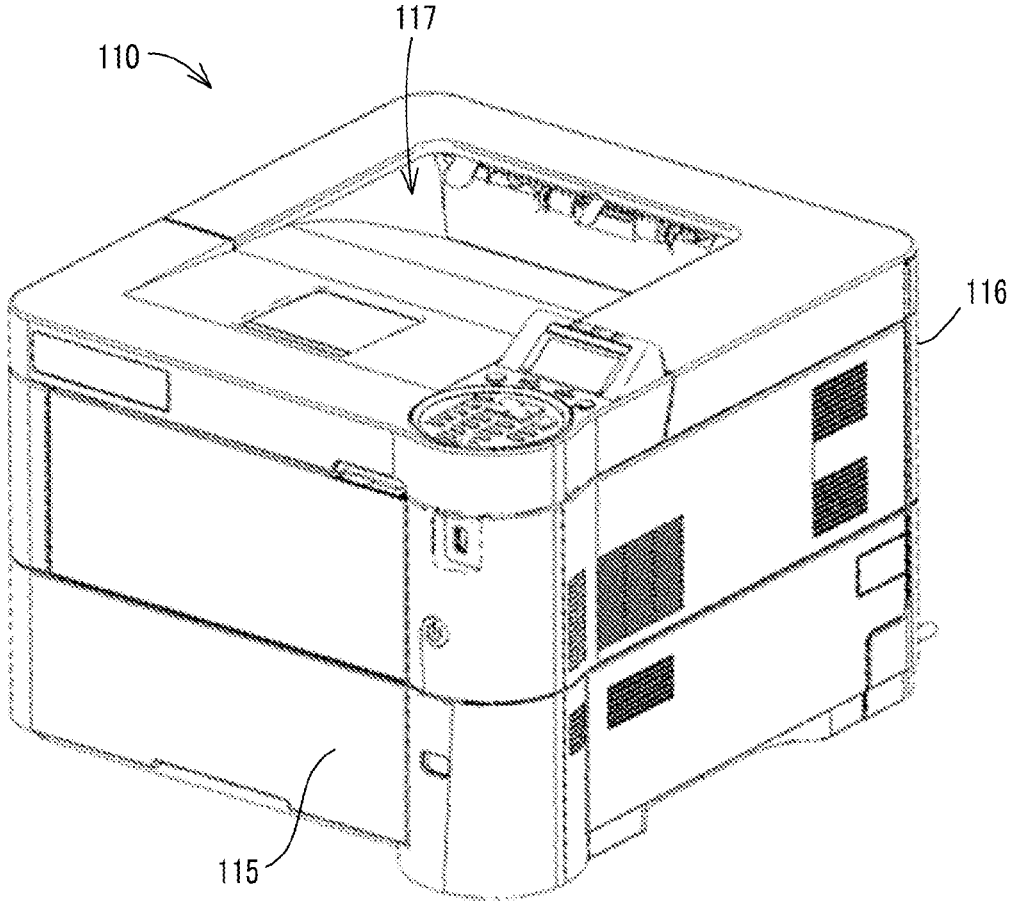
FIG. 6 is an image forming apparatus included in a pack body according to the embodiment of the present disclosure.
Figure 7A:
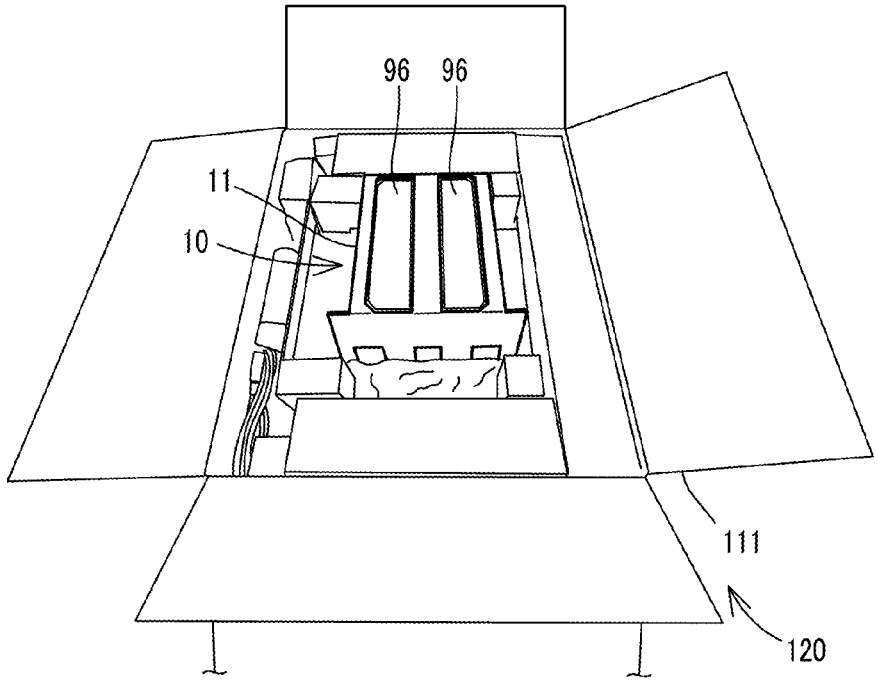
FIG. 7A and FIG. 7B are each a schematic diagram showing a structure of a pack body according to the embodiment of the present disclosure.
Figure 7B:
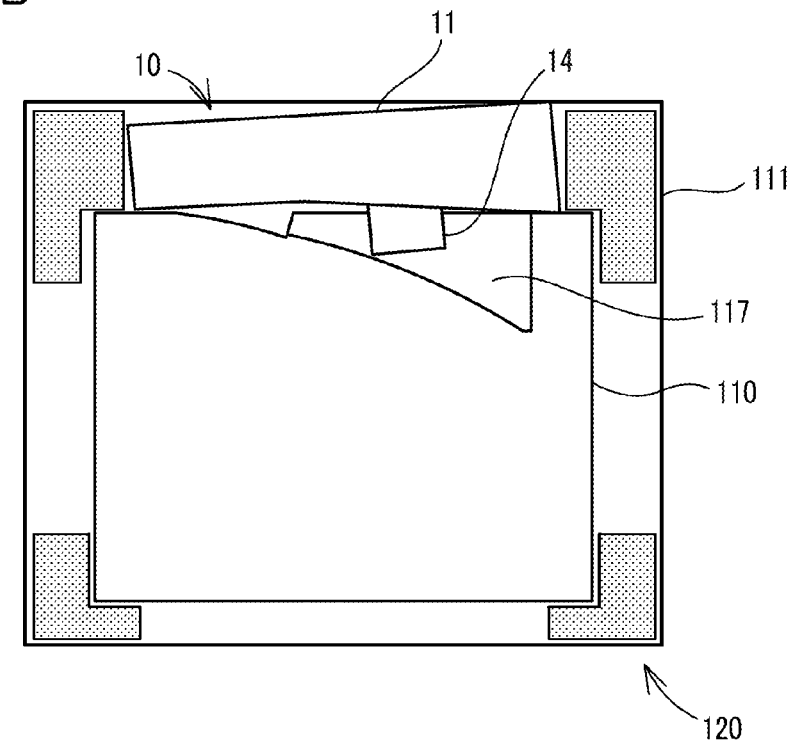

Further, in the above embodiment, a case has been described in which the packing member 10 alone is stored in the packaging box 97. However, as shown in FIG. 6 to FIG. 7B, an embodiment is also conceivable in which the packing member 10 is stored in a packaging box 111 (one example of an exterior case of the present disclosure) along with an image forming apparatus 110 (one example of a product of the present disclosure). FIG. 6 is a perspective view of the image forming apparatus 110. FIG. 7A and FIG. 7B show a pack body 120 in which the image forming apparatus 110 and the packing member 10 are packed together. The image forming apparatus 110 is an apparatus that prints an image on a print sheet based on inputted image data, and as shown in FIG. 6, is a printer including a sheet feed portion 115 and an image forming portion 116, for example. On the top face of the image forming apparatus 110, a recessed portion 117 in which discharged print sheets are held is formed. When the image forming portion 116 prints an image on a print sheet fed from the sheet feed portion 115, the print sheet is conveyed upwardly to be discharged into the recessed portion 117. In a case where the image forming apparatus 110 as described above and the packing member 10 are packed together in the packaging box 111, as shown in FIG. 7B, in the pack body 120 in which these are packed, the image forming apparatus 110 is arranged on the bottom side of the packaging box 111 and the packing member 10 having articles to be packed such as the toner cartridges 96 stored in the storage spaces 12 is arranged above the image forming apparatus 110. At this time, in a state where the packing member 10 is stored in the packaging box 111, the bottom walls 18 (18A, 18B) of the body 11 formed by the support pieces 31 and 32 abut against end portions of the top face of the image forming apparatus 110, whereby the packing member 10 is supported. Moreover, as shown in FIG. 7B, the packing member 10 is arranged such that the movable portions 14 protruding from the bottom face of the packing member 10 protrude into the space in the recessed portion 117 of the image forming apparatus 110. The pack body 120 in which the image forming apparatus 110 and the packing member 10 are packed together can eliminate the use of the cushioning materials 98 which are necessary when the packing member 10 alone is to be stored, and thus, wasteful use of storage space in the packaging box 111 can be prevented.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A packaging case to be stored in an exterior case, the packing case comprising:

a body having a storage space in which an article to be packed is to be stored, the body having openings that are formed in a top face thereof and a bottom face thereof and that are in communication with the storage space;

a fixed support portion fixed to the body and provided at a first position at which the fixed support portion is capable of supporting the article stored in the storage space; and a movable support portion provided in the body so as to be movable in the storage space, configured to support the article at the first position, along with the fixed support portion, and configured to move, when the packaging case has been taken out of the exterior case and placed on a predetermined face, to a second position defined above the first position to support the article, in a state where at least a part of the article is exposed from the opening in the top face to outside.

2. The packaging case according to claim 1, wherein the movable support portion includes an upper end portion configured to support a bottom face of the article and a lower end portion provided below the upper end portion, and the upper end portion is positioned at the first position in a state where the lower end portion protrudes from the opening in the bottom face to outside of the storage space, or is positioned at the second position in a state where the lower end portion is sunk within the storage space from the opening in the bottom face.

3. The packaging case according to claim 2, wherein in a case storage state where the packaging case is stored at a predetermined position in the exterior case, a part of a bottom face of the fixed support portion is supported on a predetermined position in the exterior case, and the lower end portion protrudes into a space formed below a bottom face of the packaging case.

4. The packaging case according to claim 2, wherein in a case placement state where the packaging case has been taken out of the exterior case and placed on the predetermined face, the upper end portion is inclined, associated with upward movement of the lower end portion due to the packaging case having been placed on the predetermined face.

5. The packaging case according to claim 1, wherein the body, the fixed support portion, and the movable support portion are formed by a sheet material being folded.

6. The packaging case according to claim 5, wherein the movable support portion is formed in a long strip shape whose one end in a longitudinal direction is a fixed end connected to the body and whose other end in the longitudinal direction is a free end being displaceable, the movable support portion being structured by being folded a plurality of times from the fixed end to the free end in a same direction.

7. The packaging case according to claim 5, wherein the body, the fixed support portion, and the movable support portion are integrally formed from a corrugated board having a sheet shape.

8. A pack body comprising: the packaging case according to claim 1; a product having a recessed portion formed in a top face thereof; and the exterior case having the packaging case and the product being packed therein, wherein the packaging case is arranged above the product, in a state where the movable support portion protrudes into the recessed portion when an entirety of the article is stored in the storage space and the movable support portion is at the first position.

* * * * *